United States Patent [19]

Nagahori et al.

[11] 4,323,393

[45] Apr. 6, 1982

[54] HOT DIPPING LEAD BASE COATING MATERIAL

[76] Inventors: Teiji Nagahori, No. 15-24 Nakaaoki 2-chome, Kawaguchi-shi, Saitama-ken; Masanori Ohshima, No. 1043 Amanuma-cho 2-chome, Ohmiya-shi, Saitama-ken, both of Japan

[21] Appl. No.: 179,478

[22] Filed: Aug. 18, 1980

Related U.S. Application Data

[63] Continuation-in-part of Ser. No. 39,579, May 16, 1979, abandoned.

[30] Foreign Application Priority Data

Jun. 9, 1978 [JP] Japan ..... 53-068922

[51] Int. Cl.[3] ..... C23B 5/14; C23B 5/38; C23B 5/40

[52] U.S. Cl. ..... 75/166 C; 75/166 B; 75/166 D

[58] Field of Search ..... 75/166 B, 166 C, 166 D

[56] References Cited

U.S. PATENT DOCUMENTS

| | | | |
|---|---|---|---|
| 320,444 | 6/1885 | Randolph | 75/166 C |
| 650,911 | 6/1900 | Rumely | 75/166 C |
| 1,059,982 | 4/1913 | Dwyer | 75/166 C |
| 2,298,237 | 10/1942 | Smith et al. | 75/166 |
| 3,793,161 | 2/1974 | Manko | 204/43 S |

*Primary Examiner*—Upendra Roy

*Attorney, Agent, or Firm*—Frishauf, Holtz, Goodman & Woodward

[57] ABSTRACT

A lead base coating material containing 0.3–30.0 weight percent, preferably 3.0–4.9 weight percent of tin and 0.001–0.3 weight percent, preferably 0.001–0.02 weight percent in phosphorus content equivalent of at least one selected from the group consisting of phosphorus, tin phosphide, zinc phosphide, antimony phosphide, bismuth phosphide and lead phosphide. The coating material has an excellent wetting to the matrix of a metal plated with the coating material, can promote the formation of an alloy phase between the plating metal matrix and a plating layer, and can also form a plating layer having an improved solderability and an improved corrosion resistivity. The coating material may further contain 0.1–7.0 weight percent of zinc and/or 0.5–35.0 weight percent of antimony, the former imparting sacrificial anodicity to the plating layer, while the latter imparting an enhanced hardness to the plating layer.

12 Claims, No Drawings

HOT DIPPING LEAD BASE COATING MATERIAL

BACKGROUND OF THE INVENTION

This is a continuation-in-part of application Ser. No. 39,579 filed May 16, 1979 and now abandoned.

This invention relates to a hot dipping lead base coating material, and more particularly to a hot dipping lead base coating material which can promote the formation of an alloy phase between the matrix of a plating material and a plating layer formed thereon and can also form a plating layer which is excellent in corrosion resistivity, solderability, sacrifical anodicity and hardness.

Conventionally, in order to impart corrosion resistivity to plates, wires, pipes, vessels and machinary parts which are made of iron steel, copper, copper alloy, nickel, or nickel alloy, it has been employed in general to subject these materials to dipping in molten lead, i.e., hot lead dipping, making use of the corrosion resistivity possessed by lead. However, satisfactory results have not so far been obtained in respect of adhesion of lead to the plating metal matrix. For instance, in subjecting iron steel articles to hot lead dipping, iron and lead form neither an intermetallic compound nor a solid solution, thus making it very difficult to obtain satisfactory results.

In order to obtain an improved wetting or plating adhesion of lead to the plating metal matrix, it has been proposed and widely used to add 0.3–30.0 weight percent of tin to lead.

However, even a hot dipping Pb-Sn alloy thus prepared is unable to provide the formation of a sufficient quantity of alloy phase between the plating metal matrix and the plating layer, thus failing to obtain a satisfactory corrosion resistivity. Further, the resulting plating layer has a very low solderability. That is, a metal material cannot be well soldered to a plating layer of the Pb-Sn alloy formed on the surface of the plating metal.

OBJECTS AND SUMMARY OF THE INVENTION

It is therefore a primary object of the invention to provide a hot dipping lead base coating material which can promote the formation of an alloy phase between the plating metal matrix and the plating layer to obtain a firm adhesion of the plating layer to said matrix, and also provide a plating layer which is much improved in corrosion resistivity as well as solderability.

It is another object of the invention to provide a hot dipping lead base coating material which is capable of forming a plating layer provided with sacrificial anodicity.

It is a further object of the invention to provide a hot dipping lead base coating material which is provided with higher hardness.

According to the invention, there is provided a hot dipping lead base coating material which consists of (1) from of 0.3 to 30.0 percent by weight, preferably from 3.0 to 4.9 percent by weight of tin, (2) from 0.001 to 0.3 percent by weight, preferably from 0.001 to 0.02 percent by weight in phosphorus content equivalent or in terms of phosphorus content of at least one selected from the group consisting of phosphorus, tin phosphide, zinc phosphide, antimony phosphide, bismuth phosphite and lead phosphide, and (3) the balance of lead and inevitable impurities. In said lead base coating material, phosphorus contained therein contributes to enhancement of the wetting property of lead to the plating metal matrix, the promotion of an alloy phase between said matrix and the plating layer, and the formation of a plating layer having an improved corrosion resistivity and an improved solderability.

If required, the lead base coating material may contain from 0.1 to 7.0 percent by weight, preferably from 1 to 6 percent by weight of zinc, and/or from 0.5 to 35.0 percent by weight, preferably from 5 to 10 percent by weight of antimony, whereby said zinc imparts sacrificial anodicity to the plating layer, while said antimony increases the hardness of the plating layer.

DETAILED DESCRIPTION

The present inventors have made researches on how to promote the formation of an alloy phase between the matrix of a plating metal and a plating layer formed thereon during hot dipping treatment so as to obtain a strong adhesion of the plating layer to the matrix, as well as to obtain a hot dipping lead base coating material which has satisfactorily high resistivity and solderability. As a result, they have discovered the following facts:

(a) If at least one selected from the group consisting of phosphorus (hereinafter referred to as P), tin phosphide (P-Sn), zinc phosphide (P-Zn), antimony phosphide (P-Sb), bismuth phosphide (P-Bi) and lead phosphide (P-Pb) is added to a conventional type lead base alloy having an Sn content of from 0.3 to 30.0 percent by weight, preferably from 3.0 to 4.9 percent by weight, the alloy exhibits an improved wetting to the matrix of a metal to be plated during hot dipping treatment, and the formation of an alloy phase between the plating layer and said matrix is promoted so that a plating layer with high adhesion to the matrix is formed. In addition, the plating layer is much superior to a plating layer formed of a conventional lead base alloy in respect of corrosion resistivity and solderability.

(b) Further, if zinc (hereinafter referred to as Zn) is added to the lead base alloy containing phosphorus and/or phosphide(s) as stated in the preceding paragraph (a), the resulting plating layer can act as a sacrificial anode, since usually Zn has a lower electrode potential than a metal to be plated (for instance, steel).

(c) Still further, if antimony (hereinafter referred to as Sb) is added to the lead base alloy described in the preceding paragraphs (a) and (b), the resulting plating layer has a higher hardness than a plating layer formed of a conventional lead base alloy.

This invention is based upon the above-given discoveries. According to the invention, a hot dipping lead base coating material is prepared by adding to a lead base alloy having an Sn content of from 0.3 to 30.0 percent by weight, preferably from 3.0 to 4.9 percent by weight the following element(s) and/or compound(s):

(1) at least one selected from the group consisting of P, P-Sn, P-Zn, P-Sb, P-Bi and P-Pb: 0.001–0.3 percent by weight, preferably 0.001–0.02 percent by weight in phosphorus content equivalent;

and if required, (2) Zn: 0.1–7.0 percent by weight, preferably 1–6 percent by weight; and/or (3) Sb: 0.5–35.0 percent by weight, preferably 5–10 percent by weight.

In the lead base coating material with the above chemical composition, the P contained therein improves the wetting of a plating layer formed of said lead base coating material to the matrix of a plating metal and promotes the formation of an alloy phase between said matrix and said plating layer, while simultaneously improving the solderability and the corrosion resistivity of the plating layer. While, the Zn imparts sacrificial anodicity to the plating layer, and the Sb increases the hardness of the plating layer.

The reasons why the ingredient contents of the lead base coating material according to the invention are limited as above are as follows:

(A) P, P-Sn, P-Zn, P-Sb, P-Bi, and P-Pb

If one or more of these ingredients are contained in less than 0.001 percent by weight in phosphorus content equivalent, the amount of a chemical compound formed on the matrix of a plating material by the reaction of P with the plating material metal is so small that a sufficient amount of alloy phase is not formed between the matrix and the plating layer. While, in excess of 0.3 percent by weight in phosphorus content equivalent, the resulting alloy phase has a too large thickness, often causing the plating layer to become stripped off the matrix surface. Therefore, the content has been limited to a range of from 0.001 to 0.3 percent by weight in phosphorus content equivalent. Within a range of from 0.001 to 0.02 percent by weight in phosphorus content equivalent, particularly good results can be obtained.

(B) Zn

It is known that zinc is usually lower in electrode potential than a metal to be plated, such as steel. Thus, addition of zinc to the lead base coating material provides sacrificial anodicity to the plating layer made of such zinc-contained lead base coating material. The zinc content of less than 0.1 percent by weight is too insufficient for causing the state in which the plating layer is relatively lower in electrode potential than the plated metal. Whilst, if the zinc content exceeds 7.0 percent by weight, white rust often occurs on the surface of the plating layer. Therefore, the Zn content has been limited to a range of from 0.1 to 7.0 percent by weight. Particularly, most satisfactory results can be obtained within a range of from 1 to 6 percent by weight.

(C) Sb

If the Sb content is less than 0.5 percent by weight, such content is too small for imparting a sufficient hardness to the plating layer. While, if the Sb content exceeds 35.0 percent by weight, a bath of the resulting lead base coating material has a melting point higher than 400° C., making it difficult to obtain a plating layer having a uniform thickness. Thus, the Sb content has been limited to a range of from 0.5 to 35.0 percent by weight. Particularly good results can be obtained within a range of from 5 to 10 percent by weight.

The invention will be more clearly understood with reference to the following Example.

EXAMPLE

First, several plate materials made respectively of mild steel, stainless steel, copper and brass, each having a square shape with a side length of 100 mm and a thickness of 0.5 mm were prepared. At the same time, a flux having the following chemical composition obtained by melting said flux was prepared:

$VCl_2$ —0.5% by weight
BiCl—0.5% by weight
$SnCl_2$—3.0% by weight
KCl—12.0% by weight
$ZnCl_2$—balance Further prepared were lead base coating materials Nos. 1–50 according to the present invention and conventional lead base alloys Nos. 1–13 having chemical compositions as indicated in Tables 1 through 3 (In the tables, the phosphorus compound contents are indicated in phosphorus content equivalent).

Said plate materials were each subjected to a pretreatment comprising the steps of (i) dipping in a trichloroethylene or an alkali solution having a temperature of from 80° to 90° C. for 10 to 30 minutes for degreasing, (ii) rinsing the degreased materials, (iii) pickling by dipping in an aqueous solution of hydrochloric acid of concentration of from 12 to 15 percent, at room temperature, for 5 to 10 minutes, and (iv) rinsing the pickled materials.

Then, the pretreated plate materials were each subjected to a flux treatment as described hereinbelow. In aqueous flux solution treatment of the mild steel and the stainless steel of said plate metal materials, a mixed aqueous solution consisting of 1 liter of an aqueous solution of hydrochloric acid of concentration of from 2 to 3 percent and 350 grams of an aqueous solution of a flux having the aforeindicated composition was used.

TABLE 1

| Test Pieces | | | Ingredient Analysis (in weight percent) | | | | | | | | | | Results of Wetting Property |
|---|---|---|---|---|---|---|---|---|---|---|---|---|---|
| Lead Base Alloys | | Plate Materials | P | P—Sn | P—Zn | P—Sb | P—Bi | P—Pb | Zn | Sb | Sn | Pb | Test ($cm^2$) |
| Coating Materials | 1 | Mild Steel | — | 0.23 | — | — | — | — | — | — | 30 | bal. | 8.6 |
| of the Invention | 2 | " | 0.06 | 0.01 | — | — | 0.02 | 0.2 | — | — | 30 | " | 8.7 |
| Conventional Alloy | 1 | " | — | — | — | — | — | — | — | — | 30 | " | 7.2 |
| Coating Materials | 3 | " | — | 0.2 | — | — | — | — | — | — | 20 | " | 7.2 |
| of the Invention | 4 | " | 0.04 | — | 0.02 | — | 0.1 | — | — | — | 20 | " | 7.2 |
| Conventional Alloy | 2 | " | — | — | — | — | — | — | — | — | 20 | " | 6.0 |
| Coating Materials | 5 | " | — | 0.1 | — | — | — | — | — | — | 10 | " | 5.6 |
| of the Invention | 6 | " | 0.02 | — | 0.05 | — | — | — | — | — | 10 | " | 5.7 |
| Conventional Alloy | 3 | " | — | — | — | — | — | — | — | — | 10 | " | 4.7 |
| | 7 | " | — | 0.06 | — | — | — | — | — | — | 6 | " | 5.2 |
| | 8 | " | 0.06 | — | — | — | — | — | — | — | 6 | " | 5.3 |
| Coating Materials | 9 | " | 0.001 | — | — | — | — | — | — | — | 4.9 | " | 5.1 |
| of the Invention | 10 | " | — | 0.3 | — | — | — | — | — | — | 3 | " | 5.0 |
| | 11 | " | — | 0.1 | — | — | — | — | — | — | 1 | " | 4.7 |
| | 12 | " | 0.02 | — | — | — | — | — | — | — | 3.5 | " | 5.0 |

TABLE 1-continued

| Test Pieces | | | Ingredient Analysis (in weight percent) | | | | | | | | | | Results of Wetting Property |
|---|---|---|---|---|---|---|---|---|---|---|---|---|---|
| Lead Base Alloys | | Plate Materials | P | P—Sn | P—Zn | P—Sb | P—Bi | P—Pb | Zn | Sb | Sn | Pb | Test ($cm^2$) |
| | 13 | " | — | 0.03 | — | — | — | — | — | — | 0.3 | " | 4.5 |
| Conventional Alloy | 4 | " | — | — | — | — | — | — | — | — | 4.9 | " | 4.0 |
| Coating Materials of the Invention | 14 | Stainless Steel | 0.28 | — | — | — | — | — | — | — | 4.5 | " | 5.1 |
| | 15 | Stainless Steel | 0.2 | — | — | — | — | 0.1 | — | — | 3.0 | " | 5.0 |
| Conventional Alloy | 5 | Stainless Steel | — | — | — | — | — | — | — | — | 30 | " | No Wetting |
| Coating Materials of the Invention | 16 | Stainless Steel | — | — | — | — | 0.28 | — | — | — | 20 | " | 7.2 |
| | 17 | Stainless Steel | — | — | 0.05 | — | 0.2 | — | — | — | 20 | " | 7.3 |
| Conventional Alloy | 6 | Stainless Steel | — | — | — | — | — | — | — | — | 20 | " | No Wetting |
| | 18 | Stainless Steel | 0.05 | — | — | — | — | 0.15 | — | — | 10 | " | 5.5 |
| Coating Materials of the Invention | 19 | Stainless Steel | 0.03 | — | 0.07 | — | 0.1 | — | — | — | 10 | " | 5.6 |
| | 20 | Stainless Steel | 0.02 | — | — | — | — | — | — | — | 4.8 | " | 4.5 |
| Conventional Alloy | 7 | Stainless Steel | — | — | — | — | — | — | — | — | 10 | " | No Wetting |
| Coating Materials of the Invention | 21 | Copper | — | — | — | — | 0.028 | — | — | — | 30 | " | 9.0 |
| | 22 | " | 0.03 | — | — | — | — | — | — | — | 30 | " | 9.0 |
| Conventional Alloy | 8 | " | — | — | — | — | — | — | — | — | 30 | " | 7.5 |
| Coating Materials of the Invention | 23 | Copper | — | — | — | — | — | 0.014 | — | — | 10 | " | 6.0 |
| | 24 | " | 0.002 | 0.01 | — | — | 0.002 | — | — | — | 10 | " | 6.0 |
| | 25 | " | 0.015 | — | — | — | — | — | — | — | 4.5 | " | 4.8 |
| Conventional Alloy | 9 | " | — | — | — | — | — | — | — | — | 10 | " | 4.9 |
| Coating Materials of the Invention | 26 | Brass | — | — | 0.028 | — | — | — | — | — | 30 | " | 9.0 |
| | 27 | " | 0.03 | — | — | — | — | — | — | — | 30 | " | 9.1 |
| Conventional Alloy | 10 | " | — | — | — | — | — | — | — | — | 30 | " | 7.5 |
| Coating Materials of the Invention | 28 | " | 0.014 | — | — | — | — | — | — | — | 10 | " | 6.0 |
| | 29 | " | 0.002 | 0.01 | — | — | 0.002 | — | — | — | 10 | " | 6.1 |
| | 30 | " | 0.01 | — | — | — | — | — | — | — | 4.0 | " | 4.5 |
| Conventional Alloy | 11 | " | — | — | — | — | — | — | — | — | 10 | " | 4.9 |

TABLE 2

| Test Pieces | | | Ingredient Analysis (in weight percent) | | | | | | | | | | Brinell |
|---|---|---|---|---|---|---|---|---|---|---|---|---|---|
| Lead Base Alloys | | Plate Materials | P | P—Sn | P—Zn | P—Sb | P—Bi | P—Pb | Zn | Sb | Sn | Pb | Hardness |
| | 30 | Mild Steel | — | — | — | 0.28 | — | — | — | 30 | 3 | bal. | 28–30 |
| | 31 | " | 0.1 | 0.03 | — | — | 0.03 | 0.1 | — | 30 | 3 | " | 28–30 |
| | 32 | " | — | — | — | 0.19 | — | — | — | 20 | 3 | " | 25–26 |
| | 33 | " | 0.05 | 0.1 | — | — | 0.05 | — | — | 20 | 3 | " | 25–26 |
| Coating Materials of the Invention | 34 | " | — | — | — | 0.14 | — | — | — | 10 | 3 | " | 20–21 |
| | 34 | " | 0.03 | 0.06 | — | 0.02 | — | — | — | 10 | 3 | " | 20–21 |
| | 36 | " | — | — | — | 0.07 | — | — | — | 5 | 3 | " | 17–18 |
| | 37 | " | 0.06 | — | — | — | — | — | — | 5 | 3 | " | 17–18 |
| | 38 | " | 0.28 | — | — | — | — | — | 3 | 30 | 3 | " | 29–31 |
| | 39 | " | 0.24 | — | — | — | — | — | 2 | 20 | 3 | " | 27–28 |
| Conventional Alloy | 12 | " | — | — | — | — | — | — | — | — | 3 | " | 13–14 |

TABLE 3

| Test Pieces | | | Ingredient Analysis (in weight percent) | | | | | | | | | | Time before Occurrence of |
|---|---|---|---|---|---|---|---|---|---|---|---|---|---|
| Lead Base Alloys | | Plate Materials | P | P—Sn | P—Zn | P—Sb | P—Bi | P—Pb | Zn | Sb | Sn | Pb | Red Rust (hr) |
| | 40 | Mild Steel | — | — | 0.28 | — | — | — | 6 | — | 30 | bal. | 1020 |
| | 41 | " | 0.1 | 0.1 | 0.03 | — | 0.02 | 0.03 | 6 | — | 30 | " | 990 |
| | 42 | " | 0.06 | 0.01 | — | — | 0.02 | 0.18 | — | — | 30 | " | 890 |
| | 43 | " | — | — | 0.14 | — | — | — | 3 | — | 15 | " | 710 |
| Coating Materials of the Invention | 44 | " | 0.05 | 0.05 | 0.02 | — | 0.02 | — | 3 | — | 15 | " | 700 |
| | 45 | " | — | 0.1 | — | — | — | — | — | — | 15 | " | 590 |
| | 46 | " | — | — | 0.07 | — | — | — | 1 | — | 5 | " | 530 |
| | 47 | " | — | — | 0.01 | — | 0.05 | — | 1 | — | 5 | " | 510 |

TABLE 3-continued

| Test Pieces | | | | | | | | | | | | | Time before |
|---|---|---|---|---|---|---|---|---|---|---|---|---|---|
| | | Plate | Ingredient Analysis (in weight percent) | | | | | | | | | | Occurrence of |
| Lead Base Alloys | | Materials | P | P—Sn | P—Zn | P—Sb | P—Bi | P—Pb | Zn | Sb | Sn | Pb | Red Rust (hr) |
| | 48 | " | — | 0.07 | — | — | — | — | — | — | 5 | " | 420 |
| | 49 | " | 0.15 | — | — | — | — | — | 1.5 | 10 | 1.5 | " | 700 |
| | 50 | " | 0.1 | — | — | — | — | — | 1.0 | 5 | 1.5 | " | 670 |
| Conventional Alloy | 13 | " | — | — | — | — | — | — | — | — | 30 | " | 72 |

While in aqueous flux solution treatment of the copper and the brass, a mixed aqueous solution consisting of 1 liter of an aqueous solution of hydrochloric acid having a concentration of from 2 to 3 percent and 270 grams of said flux was used.

The above-mentioned plate materials were dipped in the mixed aqueous flux solutions prepared as above for 10 to 30 seconds in accordance with the combinations of substrate and lead base alloys indicated in Tables 1 to 3. After that, the plating materials were again immersed, for 10 to 20 seconds, in baths of lead base coating materials and alloys of chemical compositions as indicated in Tables 1 to 3 having a both temperature of from 320° to 360° C., the baths being covered with a molten flux obtained by melting said flux, thus to provide test pieces.

The resulting test pieces obtained by dipping the plate materials in the baths of lead base coating materials Nos. 1–50 according to the invention had surfaces formed with lead base alloy plating layers with a uniform thickness range of from 8 to 10 microns having a very good plating finish. The test pieces obtained by dipping in the baths of conventional lead base alloys Nos. 1–4, 8–11 and 13 had lead base plating layers with a thickness range of from 8 to 10 microns which had a normal plating finish. The test pieces obtained by dipping in the bath of the conventional lead base alloy No. 12 had surfaces formed with a lead base alloy plating layer with a thickness range of from 8 to 10 microns which had an inferior plating finish. Further, no plating layer was formed in the test pieces obtained by dipping in the baths of the conventional lead base alloys Nos. 5–7.

Then, a wetting property test was conducted under the following conditions with respect to the lead base coating materials Nos. 1–29 according to the invention, and the conventional lead base alloys Nos. 1–4, and 8–11 in order to examine the wetting property of these alloys to the plate metal matrices:

Plate materials made respectively of mild steel, stainless steel, copper and brass and having a square shape with a side length of 30 mm and a thickness of 0.2 mm were prepared. After having the surfaces thereof cleaned through a similar pretreatment to that previously mentioned, these plate materials were dipped, for 9 to 10 seconds, in an aqueous flux solution in which $ZnCl_2$ and $NH_4Cl$ in a mole ratio of 1:1 are contained in a ratio of 200 grams per liter of water. Then, lumps of lead base coating materials Nos. 1–13 according to the invention and conventional ones Nos. 1–4, lead base coating materials Nos. 16–20 according to the invention and conventional ones Nos. 5, 6, lead base coating materials Nos. 21–25 according to the invention and conventional ones Nos. 8, 9, and lead base coating materials Nos. 26–29 according to the invention and conventional ones Nos. 10, 11, each of which has a weight of 4 grams, were placed, respectively, on said pretreated mild steel plates, stainless steel plates, copper plates and brass plates in such a fashion that one lump of lead base coating material or alloy was placed upon each one of these metal plates. These alloys and metal plates were charged into an electric furnace having an inert gas atmosphere heated to a temperature of 350° C., and heated therein for 30 seconds. After discharge from the furnace, the areas of the lead base coating materials or alloys extended over the metal plates or wetted areas were examined, results of which are also indicated in Table 1. It is evident from Table 1 that all of the lead base coating materials according to the invention provide much larger wetted areas than conventional lead base alloys having the same Sn contents as the former, respectively, which means that the former are much superior in wetting property to the latter.

Next, for the purpose of examining the solderability of the plating layers provided by the lead base coating materials of the present invention, metal plates each having its surfaces plated were prepared as test pieces under the same conditions (the test piece size, the plating conditions) as those employed in the above-given wetting proporty test, and in accordance with the combinations of the lead base coating materials and alloys and the test pieces indicated in Table 1. Lumps of ordinary type solder, each having a predetermined quantity, were placed upon these testing metal plates, followed by heating the metal plates and solder lumps in the same manner as in said wetting property test. The test results showed that the areas of the solder spreaded over the testing metal plates were much larger in lead base coating materials according to the present invention than in conventional lead base alloys having the same Sn contents as the former respectively. That is, the mean solder-spreaded area in the case of the lead base coating materials of the present invention was about 120 percent of that in the case of the conventional lead base alloys.

The Sb-containing and Zn and Sb-containing lead base coating materials Nos. 30–39 according to the invention and the conventional lead base alloy No. 12 were subjected to measurement of the hardness of the plating layers, results of which are shown in Table 2. Table 2 makes it evident that the lead base coating materials Nos. 30–39 according to the invention have much higher hardness as compared with the conventional lead base alloy No. 12.

Further, thest pieces plated respectively with the lead base coating materials Nos. 40–50 according to the invention and the conventional lead base alloy No. 13 were sprayed with a saline solution of concentration of 5 percent with a temperature of 35° C. No change occurred on the plating layer surfaces of the lead base coating materials Nos. 40–50 of the invention even after a spraying time of 360–400 hours, and red rust occurred on the surfaces of said test pieces when the times indicated in Table 3 respectively lapsed. Whilst, on the plating layer surface of the conventional lead base alloy No. 13 there occurred a few spots of red rust after a spraying time of 72 hours. From this fact, it is clear that metals plated with lead base coating materials according to the invention will exhibit much higher corrosion resistivity than metals plated with conventional lead base alloys, and particularly it is clear that metals plated with Zn-contained lead base coating materials according to the invention will have by far more excellent corrosion resistivity.

As described in the foregoing, the lead base coating material according to the present invention possesses a very excellent wetting property due to the action of phosphorus contained therein, and can provide the surfaces of various metals with lead base alloy plating which has corrosion resistivity and solderability much superior to those of a conventional lead base alloy and, if required, can also possess sacrificial anodicity and/or high hardness.

What is claimed is:

1. A hot dipping lead base coating material which consists of from 0.3 to 4.9 percent by weight of tin, from 0.001 to 0.3 percent by weight in phosphorus content equivalent of at least one selected from the group consisting of phosphorus, tin phosphide, zinc phosphide, antimony phosphide, bismuth phosphide and lead phosphide, and the balance of lead and inevitable impurities.

2. The lead base coating material is recited in claim 1, wherein tin is contained in an amount of from 3.0 to 4.9 percent by weight.

3. The lead base coating material as recited in claim 1, wherein at least one selected from the group consisting of phosphorus, tin phosphide, zinc phosphide, antimony phosphide, bismuth phosphide and lead phosphide is contained in an amount of from 0.001 to 0.02 percent by weight in phosphorus content equivalent.

4. A hot dipping lead base coating material which consists of from 0.3 to 30.0 percent by weight of tin, from 0.001 to 0.3 percent by weight in phosphorus content equivalent of at least one selected from the group consisting of phosphorus, thin phosphide, zinc phosphide, antimony phosphide, bismuth phosphide and lead phosphide, from 5 to 35.0 percent by weight of antimony, and the balance of lead and inevitable impurities.

5. The lead base coating material as recited in claim 4, wherein tin is contained in an amount of from 0.3 to 4.9 percent by weight.

6. The lead base coating material as recited in claim 4, wherein at least one selected from the group consisting of phosphorus, tin phosphide, zinc phosphide, antimony phosphide, bismuth phosphide and lead phosphide is contained in an amount of from 0.001 to 0.02 percent by weight in phosphorus content equivalent.

7. The lead base coating material as recited in claim 4, wherein antimony is contained in an amount of from 5 to 10 percent by weight.

8. A hot dippping lead base coating material which consists essentially of from 0.3 to 30.0 percent by weight of tin, from 0.001 to 0.3 percent by weight in phosphorus content equivalent of at least one selected from the group consisting of phosphorus, tin phosphide, zinc phosphide, antimony phosphide, bismuth phosphide and lead phosphide, from 0.1 to 7.0 percent by weight of zinc, from 5 to 35.0 percent by weight of antimony, and the balance of lead and inevitable impurities.

9. The lead base coating material as recited in claim 8, wherein tin is contained in an amount of from 0.3 to 4.9 percent by weight.

10. The lead base coating material as recited in claim 8, wherein at least one selected from the group consisting of phosphorus, tin phosphide, zin phosphide, antimony phosphide, bismuth phosphide and lead phosphide is contained in an amount of from 0.001 to 0.02 percent by weight in phosphorus content equivalent.

11. The lead base coating material as recited in claim 8, wherein zinc is contained in an amount of from 1 to 6 percent by weight.

12. The lead base coating material as recited in claim 8, wherein antimony is contained in an amount of from 5 to 10 percent by weight.

* * * * *